US006401701B1

(12) United States Patent
Liu

(10) Patent No.: US 6,401,701 B1
(45) Date of Patent: Jun. 11, 2002

(54) FOUR-STROKE CYCLE INTERNAL COMBUSTION ENGINE

(75) Inventor: Yumin Liu, Fussa (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 09/655,877

(22) Filed: Sep. 6, 2000

(30) Foreign Application Priority Data

Sep. 10, 1999 (JP) ..... 11-257482

(51) Int. Cl.[7] ..... F02M 25/06
(52) U.S. Cl. ..... 123/572
(58) Field of Search ..... 123/572, 573, 123/574

(56) References Cited

U.S. PATENT DOCUMENTS

| | | | | | |
|---|---|---|---|---|---|
| 4,721,090 | A | * | 1/1988 | Kato | 123/572 |
| 4,760,833 | A | * | 8/1988 | Tatyrek | 123/572 |
| 4,768,493 | A | * | 9/1988 | Ohtaka et al. | 123/573 |
| 4,862,860 | A | * | 9/1989 | Shinohara | 123/572 |
| 4,962,745 | A | * | 10/1990 | Ohno et al. | 123/572 |
| 5,024,203 | A | * | 6/1991 | Hill | 123/573 |
| 5,347,967 | A | | 9/1994 | Todero et al. | |
| 5,579,735 | A | | 12/1996 | Todero et al. | |
| 5,582,145 | A | * | 12/1996 | Aizawa et al. | 123/572 |
| 6,167,874 | B1 | | 1/2001 | Becker et al. | |

OTHER PUBLICATIONS

Patent Abstracts of Japanese: Publication No.: 05222944, Publication Date: Aug. 31, 1993.
Patent Abstracts of Japanese: Publication No.: 11223116, Publication Date: Aug. 17, 1999.

* cited by examiner

*Primary Examiner*—Marguerite McMahon
(74) *Attorney, Agent, or Firm*—Nixon Peabody LLP; Donald R. Studebaker

(57) ABSTRACT

The present invention relates to a four-stroke cycle internal combustion engine which is adapted to lubricate the inside of the engine using a mixed fuel composed of fuel and lubricant. The four-stroke cycle internal combustion engine includes a combustion chamber; an intake port which opens toward the combustion chamber; an air intake passage communicating with the intake port, the air intake passage having a downstream side air intake passage which is located on a downstream side of a fuel supply device for supplying the mixed fuel to the air intake passage; a crank shaft; a crank chamber accommodating the crank shaft; a branch passage branching off from the air intake passage for communicating the downstream side air intake passage of the air intake passage with the crank chamber; a valve system; a valve chamber accommodating the valve system; a communication passage for communicating the crank chamber with the valve chamber; a circulation passage for communicating the valve chamber with the air intake passage; and a valve disposed in the branch passage for opening and closing the branch passage.

11 Claims, 8 Drawing Sheets

(intake stroke)

(compression stroke)

(expansion stroke)

(exhaust stroke)

(intake stroke)

(compression stroke)

(expansion stroke)

(exhaust stroke)

FOUR-STROKE CYCLE INTERNAL COMBUSTION ENGINE

BACKGROUND OF THE INVENTION

The present invention relates to a four-stroke cycle internal combustion engine preferably used for a power source of compact power working machine such as a portable grass trimmer, a lawn mower, a chain saw, or the like.

DESCRIPTION OF THE PRIOR ART

A portable working machine represented by a grass trimmer and a chain saw is required to allow an operator to work without any restriction on his working position or posture. Thus, an internal combustion engine as a power source mounted on such working machine is required to keep a stable operation even if it is used, for example, in a laterally tilted position.

In order to comply with such a request, conventionally, there has been generally utilized a compact air-cooled two-stroke cycle gasoline engine (hereinafter referred to as two-stroke cycle engine) which uses mixed fuel composed of fuel and lubricating oil mixed at a predetermined ratio. However, since the two-stroke cycle engine generally produces exhaust gas containing an abundance of unburned gas due to a gas-flow type scavenging system employed therein, it has a disadvantage in that it is difficult to take an effective measure to control exhaust gas or emission.

As for the emission control, the four-stroke cycle internal combustion engine (Otto engine) has the advantage of producing exhaust gas containing a small amount of unburned gas, and thereby the four-stroke cycle internal combustion engine is requested to be employed in a portable working machine in place of the; two-stroke cycle engine. In the four-stroke cycle engine, typically an oil reservoir is disposed in a bottom section of a crankcase in which a crankshaft is accommodated, and the oil in the oil reservoir is drawn by a pump or splashed by a rotating member to lubricate an inner surface of a cylinder and a valve system. However, this likely results in a complicated structure and an increased weight due to an additional mechanism for oil delivery and recovery, which is undesirable for a portable working machine.

In addition, the use of an oil reservoir forces the operator to hold the engine in a specific position (generally in an upright position) in use, which makes it difficult to apply a typical four-stroke cycle engine to a portable working machine without modification. Further, there is a fear of engine seizure due to an insufficient oil supply or lack of oil caused by a change in a position or posture thereof. Consequently, this might interfere with the operational convenience associated with the use of a portable working machine. Heretofore, various proposals have been submitted in order to improve above situation, one of which is to use mixed fuel composed of fuel and lubricant oil in the four-stroke cycle engine as in the two-stroke cycle engine.

In a four-stroke cycle internal combustion engine powered by the mixed fuel, as shown in Japanese Patent Laid-open Disclosure Nos. Hei 5-222944 and Hei 7-150920, and in Descriptions of U.S. Pat. Nos. 5,347,967 and 5,579,735, an air intake system device including a carburetor is directly connected to a crankcase defining a crank chamber, and a mist-like mixed fuel which includes lubricant oil is introduced through the air intake system device into the crankcase to lubricate the inner surface of the cylinder and the rotating members in the crank chamber, and then is introduced into a cylinder/head through an air guide tube connecting the crankcase to the cylinder head, and also lubricates the valve system in the cylinder head where it is introduced into a combustion chamber through an intake port.

Since employing a four-stroke cycle internal combustion engine using mixed fuel allows to dispense with the oil reservoir in the bottom section of the crank chamber or an independent oil supply device (a pump or a member to splash the oil) and also an oil recovery device, there are provided several advantages, for example, the stable operation of engine, that can be secured even if it is used under various positions or the postures, and that an excellent property of light weight and simple structure as the engine for the portable working machine may be maintained.

However, since the configuration for directly connecting the air intake system device including a fuel supply means such as the carburetor to the crankcase is quite different from that of the conventional four-stroke cycle internal combustion engine in which the air intake system device is connected to the intake port of the cylinder head, there occurs a problem that a great modification shall be applied to an engine design.

Additionally, since the mixed fuel to be introduced into the combustion chamber first enters the crank chamber through the air intake system device directly connected to the crankcase and then enters the cylinder head through the air guide tube connecting the crankcase to the cylinder head to go finally into the combustion chamber, the length of the air intake passage to the intake port becomes quite long, which will likely result in a problem of deteriorated startability and response.

SUMMARY OF THE INVENTION

Accordingly, an object of the present invention is to provide a four-stroke cycle internal combustion engine capable of being lubricated properly with mixed fuel containing fuel and lubricant oil without modifying a basic layout of the conventional four-stroke cycle internal combustion engine.

Another object of the present invention is, adding to the above object, to provide a four-stroke cycle internal/combustion engine adapted to control a possible deterioration of response.

In addition to the two objects described above, another object of the present invention is described above, to provide a four-stroke cycle internal combustion engine adapted to control a possible deterioration of startability.

Another object of the present invention is to provide a light weight, clean and easily operable four-stroke cycle internal combustion engine for the portable working machine.

According to the present invention, these objects of the present invention described above can be basically achieved by a four-stroke cycle internal combustion engine whose inside being lubricated using a mixed fuel composed of fuel and lubricant added thereto, the engine including:

- a combustion chamber;
- an intake port which opens toward said combustion chamber;
- an air intake passage in communication with said intake port,
- a fuel supply device for supplying said mixed fuel to said air intake passage;
- a downstream side air intake passage which bifurcates from said air intake passage and located on a downstream side of said fuel supply device;

a crank chamber;

a crank shaft disposed within said crank chamber;

a branch passage for placing said downstream side air intake passage in communication with said crank chamber;

a valve chamber;

a valve system disposed within said valve chamber, said valve system including an intake valve and an exhaust valve;

a communication passage for placing said crank chamber in communication with said valve chamber;

a circulation passage for providing communication between said valve chamber and said air intake passage; and a first valve disposed within said branch passage for opening and closing said branch passage.

According to the four-stroke cycle internal combustion engine of the present invention, since the air intake passage including the fuel supply means communicates, as a conventional four-stroke cycle internal combustion engine, with the intake port; opening to the combustion chamber to introduce an air-fuel mixture from the air intake passage through the branch passage into the crank chamber as well, the engine internals are properly lubricated by the lubricant oil contained in the air-fuel mixture. Accordingly, in the four-stroke cycle internal combustion engine of the present invention, since the oil reservoir generally used in the conventional engine is not necessary and a basic layout of the conventional four-stroke cycle internal combustion engine can be employed without modification, a practical benefit such as a reduction of development costs otherwise necessary for engine design may be provided, and the response performance equivalent to that of the conventional four-stroke cycle internal combustion engine may be secured due to the fact that the air-fuel mixture is introduced into the cylinder in a different stroke from that for the crankcase.

In a preferred embodiment of the present invention, a switch valve for opening or closing the circulation passage is interposed within the circulation passage which makes the valve chamber in communication with the downstream side air intake passage. Thus, since the circulation passage is shut off by closing the switch valve when the engine is to be started, and thereby, at least in an intake stroke, the configuration of the four-stroke cycle internal combustion engine of the present invention is substantially the same with that of the conventional one, the startability and a driving stability in the starting and succeeding period thereof can be secured.

Other objects and operational effects of the present invention will be best understood from the following description of the preferred embodiments of the present invention.

BRIEF DESCRIPTION OF THE DRAWINGS

FIGS. 3*a*–3*d* are operation charts of the engine of the first embodiment of the present invention in which FIG. 3*a* shows an intake stroke, FIG. 3*b* shows a compression stroke, FIG. 3*c* shows an expansion stroke and FIG. 3*d* shows an exhaust stroke;

FIGS. 6*a*–6*d* are operation charts of the engine of the second embodiment of the present invention in which FIG. 6*a* shows an intake stroke, FIG. 6*b* shows a compression stroke, FIG. 6*c* shows an expansion and FIG. 6*d* shows an exhaust stroke;

DESCRIPTION OF THE PREFERRED EMBODIMENT

Figure 1:
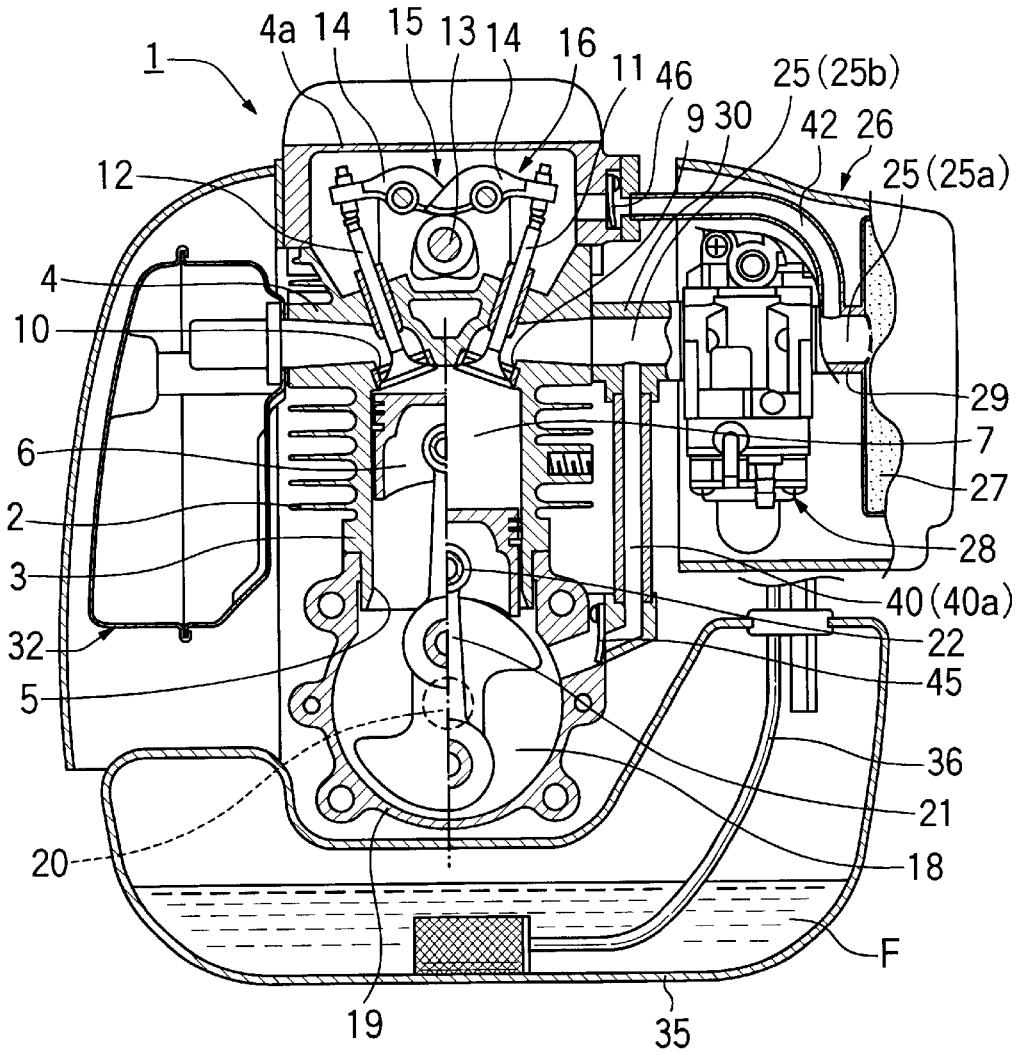
FIG. 1 is a longitudinal sectional view of an engine taken on a plane normal to a crankshaft, illustrating a first embodiment of the present invention.

Referring to the drawings attached herewith, preferred embodiments of the present invention shall be described.

Figure 2:
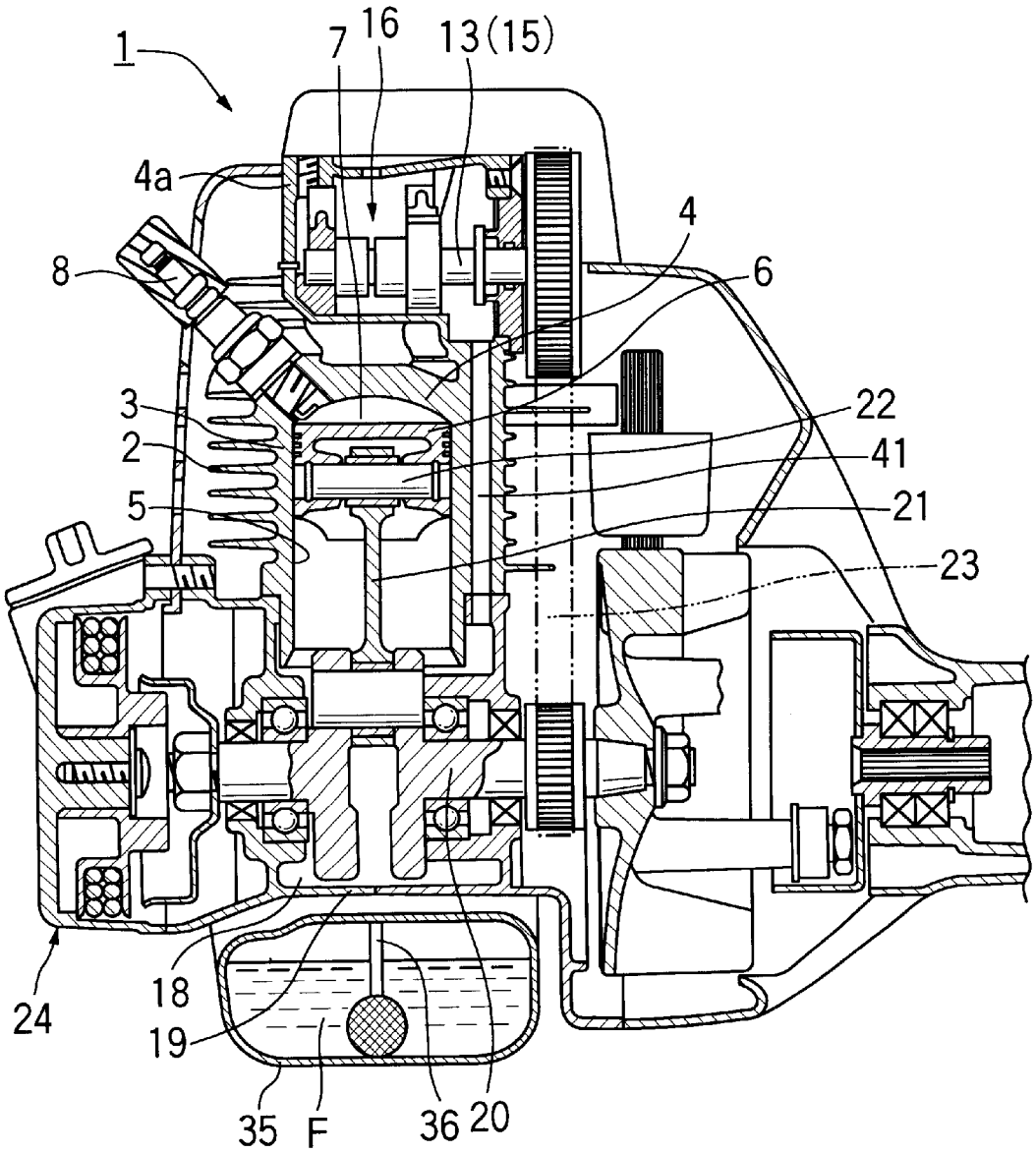
FIG. 2 is a longitudinal sectional view of the engine taken on a plane along the crankshaft center line, illustrating the first embodiment of the present invention.

FIGS. 1 and 2 show a first embodiment of an air-cooled single cylinder four-stroke cycle internal combustion engine in accordance with the present invention. FIG. 1 is a longitudinal sectional view of the engine of the first embodiment taken on a plane normal to a crankshaft thereof, and FIG. 2 is a longitudinal sectional view of the engine of FIG. 1 taken on a plane along the crankshaft center line thereof.

The engine 1 shown in FIGS. 1 and 2 has relatively small displacement of about 20 to 30 cubic centimeters, which illustrates a configuration designed as a power source for a portable grass trimmer. The engine 1 comprises a cylinder block 3 having a cooling fins 2 and a cylinder head 4 integrally fixed onto said cylinder block 3, wherein a combustion chamber 7 is formed between a piston 6 vertically slidably inserted into a cylinder bore 5 of the cylinder block 3 and the cylinder head 4.

The cylinder head 4 comprises a spark plug 8 disposed facing the combustion chamber 7 (FIG. 2), and an intake port 9 and an exhaust port (FIG. 1), both opening to the combustion chamber 7, wherein the intake port 9 and the exhaust port 10 are opened or closed by an intake valve 11 or an exhaust valve 12 respectively.

Further, in the engine 1 shown in the drawings, a valve chamber 16 is defined by the cylinder head 4 and a head cover 4*a* mounted thereon for accommodating a valve system 15 including a cam shaft 13, rocker arms 14 or the like (FIG. 1). That is, the engine 1 is of a so-called OHC type. Though the valve system 15 includes as one of the main components thereof a valve spring for forcing the rocker arm 14 into a closing direction of the intake valve 11 and the exhaust valve 12, the spring is not shown in the drawing to make it simple.

A crankcase 19 is attached to a bottom of the cylinder block 3 for defining a closed crank chamber 18, and a crank shaft 20 disposed within the crank chamber 18 as an engine output shaft is connected to the piston 6 through a connecting rod 21 and a piston pin 22. The crank shaft 20 is operatively connected to the cam shaft 13 through a timing belt 23 (FIG. 2), and thereby the intake valve 11 and the exhaust valve 12 are opened and closed in a specified timing in response to a movement of the piston 6. In FIG. 2, reference numeral 24 designates a recoil starter, which is operatively connected to the crank shaft 20. When the engine 1 is to be started, the recoil starter 24 is used to manually start the engine 1.

An air intake system device 26 is connected to the intake port 9, as shown in FIG. 1, for forming an air intake passage 25 communicating therewith, and the air intake system device 26 comprises an air cleaner 27, a diaphragm type carburetor 28 or a fuel supply means including a throttle valve (not shown), an upstream side intake pipe 29 defining an upstream side air intake passage 25*a* located in an upstream side: of the carburetor 28 by connecting the air cleaner 27 to the carburetor 28, and a downstream side intake pipe 30 defining a downstream side air intake passage 25*b* located in a downstream side of the carburetor 28 by connecting the carburetor 28 to the intake port 9. In addition, a muffler 32 is connected to the exhaust port 10 as an exhaust system device.

A fuel tank 35 is disposed under the engine 1 adjacent to the crank case 19 for reserving a mixed fuel F composed of gasoline as a fuel and lubricant added thereto. The mixed fuel F id the fuel tank 35 is supplied through a pipe 36 to the carburetor 28 to be atomized therein and discharged into the air intake passage 25 thereby.

Further, the engine 1 has a first outer pipe 40 (FIG. 1) connecting the downstream side intake pipe 30 to the crank case 19 so as to make the downstream side air intake passage 25*b* communicate with the crank chamber 18, that is, a branch passage 40*a* branching off from the downstream side air intake passage 25*b* for introducing an air-fuel mixture in the downstream side air intake passage 25*b* into the crank chamber 18 is formed by the first outer pipe 40. The engine 1 also has an internal passage 41 (FIG. 2) vertically extending through the cylinder block 3 so as to make the crank chamber 18 communicate with the valve chamber 16 to introduce the air-fuel mixture in the crank chamber 18 into the valve chamber 16, and a second outer pipe 42 (FIG. 1) connecting the cylinder head 4 (or the head cover 4a) to the upstream side intake pipe 29 so as to form a circulation passage for discharging the air-fuel mixture in the valve chamber 16 into the upstream side air intake passage 25*a*.

In the engine 1, a first lead valve 45 (FIG. 1) is attached to the crank case 19 so as to be interposed between the first outer pipe 40 and the crank chamber 18. In addition, a second lead valve 46 (FIG. 1) is attached to the cylinder head 4 (or head cover 4*a*) so as to be interposed between the valve chamber 16 and the second outer pipe 42. The first lead valve 45 allows a fluid flow from the air intake passage 25 to the crank chamber 18 and prohibits the fluid flow in its reverse direction. That is, when a pressure in the crank case 18 is lower than that in the air intake passage 25, the first lead valve 45 is opened to introduce the air-fuel mixture in the downstream side air intake passage 25*b* through the branch passage 40*a* into the crank chamber 18, and, on the contrary, when the pressure in the crank case 18 is higher than that in the air intake passage 25, the first lead valve 45 is closed to prevent the air-fuel mixture in the crank chamber 18 from flowing backward through the branch passage 40*a* into the downstream side air intake passage 25*b*.

The second lead valve 46 allows a fluid flow from the valve chamber 16 to the upstream side air intake passage 25*a* and prohibits the fluid flow in its reverse direction. That is, when the pressure in the valve chamber 16 is higher than the pressure in the upstream side air intake passage 25*a*, the second lead valve 46 is opened to allow the air-fuel mixture having been introduced from the crank chamber 18 through the internal passage 41 (FIG. 2) into the valve chamber 16 to flow back to the air intake passage (upstream side air intake passage 25*a*), and, on the contrary, when the pressure in the valve chamber 16 is lower than the pressure in the upstream side air intake passage 25*a*, the second lead valve 46 is closed to prevent the fresh air in the upstream side air intake passage 25*a* from flowing into the valve chamber 16. The second lead valve 46 is not necessarily indispensable but may be dispensed with.

Figure 3A:
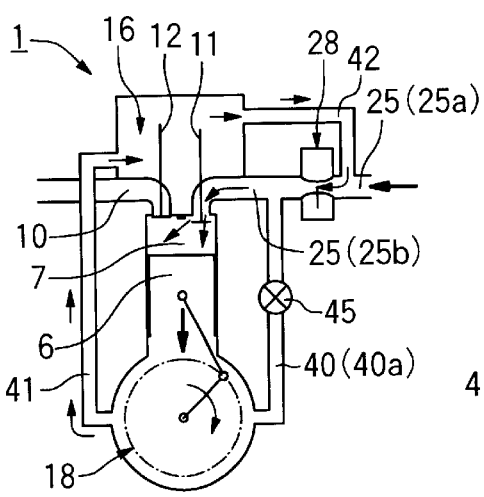
Figure 3B:
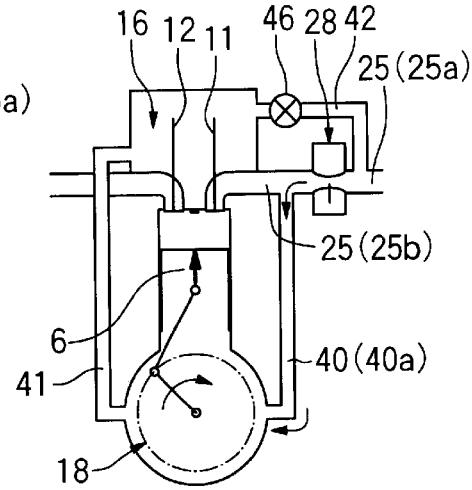
Figure 3C:
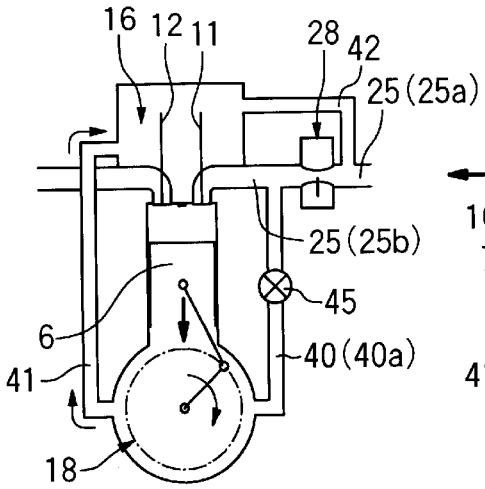
Figure 3D:
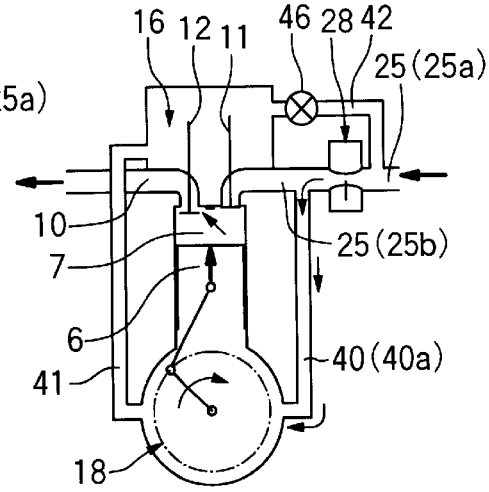

Then the operation of the engine 1 will be described with reference to FIG. 3. FIG. 3 is an operation chart of the engine 1 in which FIG. 3*a* shows an intake stroke, FIG. 3*b* shows a compression stroke, FIG. 3*c* shows an expansion stroke and FIG. 3*d* shows an exhaust stroke. In FIG. 3*a* to FIG. 3*d*, the first and the second lead valves 45, 46 are symbolically shown only when they are closed.

When the engine 1 is in its intake stroke, as can be seen from FIG. 3*a*, the exhaust valve 12 is closed while the intake valve 11 being opened, and, since the piston 6 is moved downward under this condition, the air-fuel mixture is introduced into the combustion chamber 7 through the air intake passage 25. In the intake stroke, the crank chamber 18 is led into a positive pressure as the piston 6 is moved downward. Accordingly, the first lead valve 45 is kept in the closed condition and thereby the air-fuel mixture is not introduced from the downstream side air intake passage 25*b* into the crank chamber 18 during the intake stroke. On the other hand, the air-fuel mixture in the crank chamber 18 is pushed out into the internal passage 41 by the downward stroke of the piston 6 and flows through the internal passage 41 into the valve chamber 16 to lubricate relating components.

When the engine 1 moves to the compression stroke, as can be seen from FIG. 3*b*, both of the intake valve 11 and the exhaust valve 12 are closed, and under this condition the piston 6 is moved upward to compress the air-fuel mixture in the combustion chamber 7. In the compression stroke, the crank chamber 18 is led into a negative pressure as the piston is moved upward. Accordingly, the first lead valve 45 is kept open and thereby the air-fuel mixture in the downstream side air intake passage 25*b* is introduced into the crank chamber 18 through the branch passage 40*a*.

Since a negative pressure in the crank chamber 18 has an effect through the internal passage 41 on a pressure in the valve chamber 16 to make it negative, the second lead valve 46 is closed. Thereby, the fresh air in the upstream side air intake passage 25*a* can be prevented from flowing into the valve chamber 16 through the second outer pipe 42.

Then the air-fuel mixture in the combustion chamber 7 is burned by the spark plug 8, and the engine 1 moves to the expansion stroke shown in FIG. 3*c*. In the expansion stroke, as can be seen from FIG. 3*c*, both of the intake valve 11 and the exhaust valve 12 are closed, and under this condition the piston 6 is moved downward in the expansion stroke, the crank chamber 18 is led into a positive pressure as the piston 6 is moved downward. Accordingly, the first lead valve 45 is kept in the closed condition and thereby the air-fuel mixture is not introduced from the downstream side air intake passage 25*b* into the crank chamber 18 during the expansion stroke. On the other hand, the air-fuel mixture in the crank chamber 18 is pushed out into the internal passage 41 by the downward stroke of the piston 6 and flows through the internal passage 41 into the valve chamber 16.

Upon completing the expansion stroke, the engine 1 moves to the exhaust stroke. In the exhaust stroke, as can be seen in FIG. 3*d*, the intake valve 11 is in the closed condition while the exhaust valve 12 is in the open condition, and, since under this condition the piston 6 is moved upward, burned gas in the combustion chamber 7 is exhausted outward through the exhaust port 10 and the muffler 32. In the exhaust stroke, the crank chamber 18 is led into a negative pressure as the piston 6 is moved upward. Accordingly, the first lead valve 45 is kept open and thereby the air-fuel mixture in the downstream side air intake passage 25*b* is introduced into the crank chamber 18 through the branch passage 40*a*.

Since the negative pressure in the crank chamber 18 has an effect through the internal passage 41 on the pressure in the valve chamber 16 to make it negative, the second lead valve 46 is closed. Thereby, the fresh air from the air cleaner 27 can be prevented from flowing from the upstream side air intake passage 25*a* through the second outer pipe 42 into the valve chamber 16.

Upon completing the exhaust stroke, the engine 1 returns to the intake stroke described above, and then repeats the compression stroke, the expansion stroke and the exhaust stroke in this order. When the engine 1 moves from the exhaust stroke to the intake stroke, as can be seen in FIG. 3*a*, the air-fuel mixture in the valve chamber 16 flows through the outer pipe 42 into the upstream side air intake passage 25*a*. The air-fuel mixture flowed back to the air intake passage 25 passes through the carburetor 28 again, and then is introduced through the downstream side air intake passage 25*b* and the intake port 9 into the combustion chamber 7.

According to the engine 1 of the first embodiment described above, in the compression stroke (FIG. 3*b*) and the exhaust stroke (FIG. 3*d*), the air-fuel mixture in the downstream side air intake passage 25*b* is introduced through the branch passage 40*a* into the crank chamber 18, and then the air-fuel mixture introduced into the crank case 18 flows into the valve chamber 16 during the expansion stroke (FIG. 3*c*) or the intake stroke (FIG. 3*a*), and eventually the air-fuel mixture in the valve chamber 16 flows back to the air intake passage 25 (upstream side air intake passage 25*a*) during the intake stroke (FIG. 3*a*).

Thus, the air-fuel mixture is introduced into the crank chamber 18 and the valve chamber 16 during a series of/engine strokes and provides a necessary lubrication for the engine internals by the lubricant which is contained in the air-fuel mixture as described above. Accordingly, an oil reservoir generally indispensable to the conventional four-stroke cycle internal combustion engine is not necessary, and consequently there is no fear of engine's 1 falling into unstable condition due to an insufficient lubrication even when, for example, the grass trimmer equipped with the engine 1 (not shown) is excessively tilted clockwise or counter-clockwise during operation thereof.

Further, since the engine 1 employs a configuration in which the air intake system device 26 is connected, as the conventional four-stroke cycle internal combustion engine, to the intake port 9 opening to the combustion chamber 7, the basic layout of the conventional four-stroke cycle internal combustion engine can be applied to the design of the engine 1 without modification, and consequently a practical benefit such as a reduction of development costs otherwise necessary for engine design may be provided. In addition, since this configuration allows the air-fuel mixture to be supplied to the inlet port 9 opening to the combustion chamber 7 through the intake system component 26 directly communicating therewith, the same degree of response performance can be secured with that of the conventional four-stroke cycle internal combustion engine in which the intake system is coupled with the intake port. That is, an improved response performance can be provided compared with the conventional four-stroke cycle internal combustion engine in which the intake system component is directly coupled with the crank case to lubricate by the mixed fuel.

Figure 4:
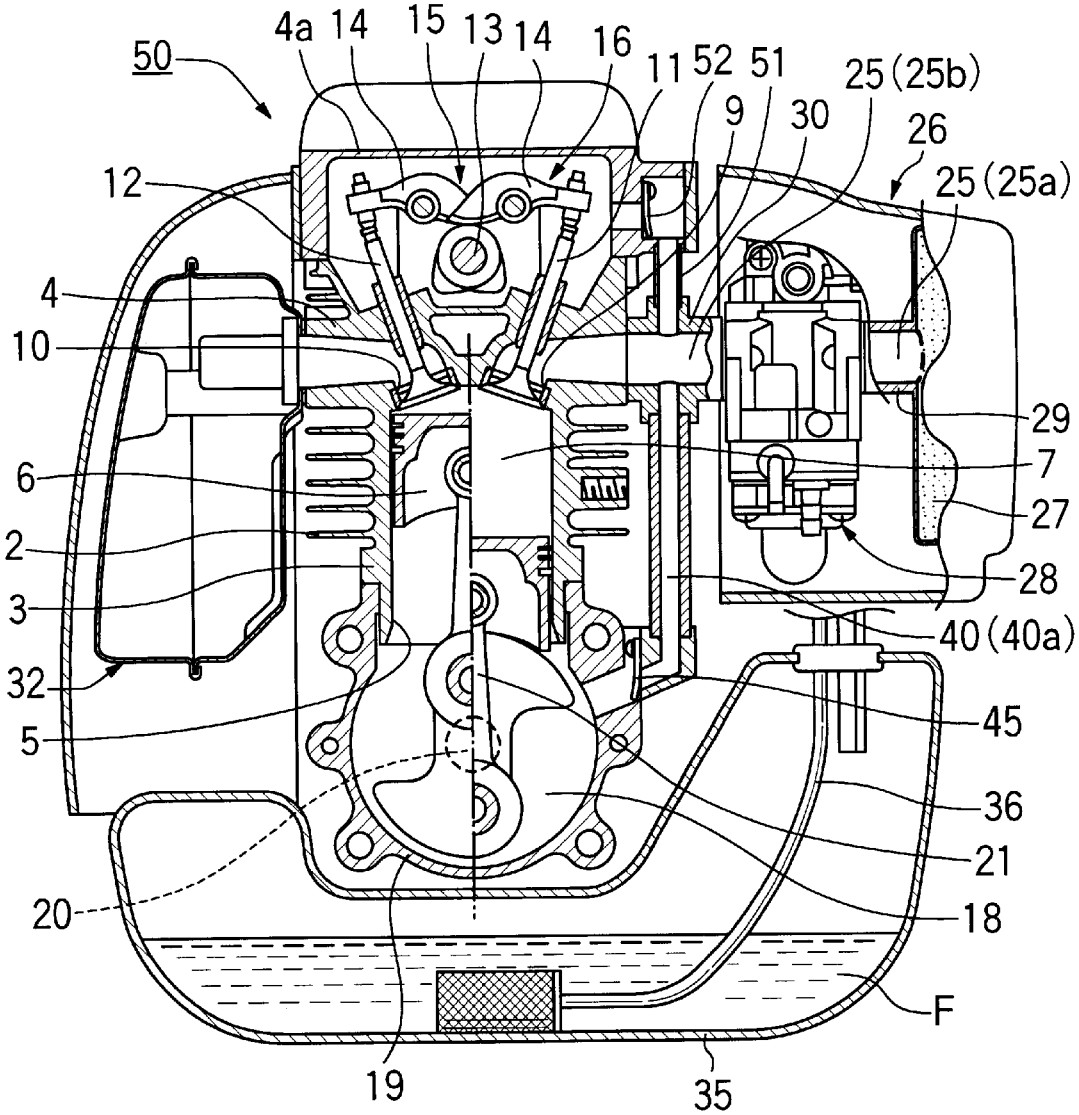
FIG. 4 is a longitudinal sectional view of an engine taken on a plane normal to a crankshaft, illustrating a second embodiment of the present invention.

In and after FIG. 4 are shown other embodiments of the present invention, in which the same reference numerals designate the same or corresponding components throughout the several drawings to omit the description thereof. Characteristic portions of the embodiments shown in and after FIG. 4 will be described.

FIG. 4 is a longitudinal sectional view of an engine taken on a plane normal to a crankshaft, illustrating a second embodiment of the present invention. The engine 50 shown in FIG. 4 has, as the engine 1 of the first embodiment described above, the first outer pipe 40 connecting the downstream side intake pipe 30 to the crank case 19 so as to make the downstream side air intake passage 25*b* communicate with the crank chamber 18, and the internal passage 41 (not shown) or a communication passage vertically extending through the cylinder block 3 so as to introduce the air-fuel mixture in the crank chamber 18 into the valve chamber 16. The engine 50 of the second embodiment differs from the engine 1 of the first embodiment in a point that the engine 50 has an third outer pipe 51 connecting the cylinder head 4 (or the head cover 4*a*) to the downstream side intake pipe 30 so as to form a circulation passage for discharging the air-fuel mixture in the valve chamber 16 into the downstream side air intake passage 25*b*.

That is, the engine 50 of the second embodiment differs from the engine 1 of the first embodiment in the point that the former is configured, as can be seen from FIG. 4, to make the air-fuel mixture in the valve chamber 16 flow back to the downstream side air intake passage 25*b* while the latter is configured to make the air-fuel mixture in the valve chamber 16 flow back to the upstream side air intake passage 25*a* (FIG. 1).

In the engine 50 of the second embodiment, a third lead valve 52 is attached to the cylinder head 4 (or head cover 4*a*) so as to be interposed between the valve chamber 16 and the third outer pipe 51. The function of the third lead valve 52 is substantially equivalent to that of the second lead valve 46 of the engine 1 of the first embodiment. That is, the third lead valve 52 allows a fluid flow from the valve chamber 16 to the downstream side air intake passage 25*b* and prohibits the fluid flow in its reverse direction. Accordingly, when the pressure in the valve chamber 16 is higher than the pressure in the downstream side air intake passage 25*b* the third lead valve 52 is opened to allow the air-fuel mixture having been introduced into the valve chamber 16 to flow back to the air intake passage 25 (downstream side air intake passage 25*b*), and, on the contrary, when the pressure in the valve chamber 16 is lower than the pressure in the downstream side air intake passage 25*b*, the third lead valve 52 is closed to prevent the air-fuel mixture in the downstream side air intake passage 25*b* from flowing into the valve chamber 16.

Figure 5:
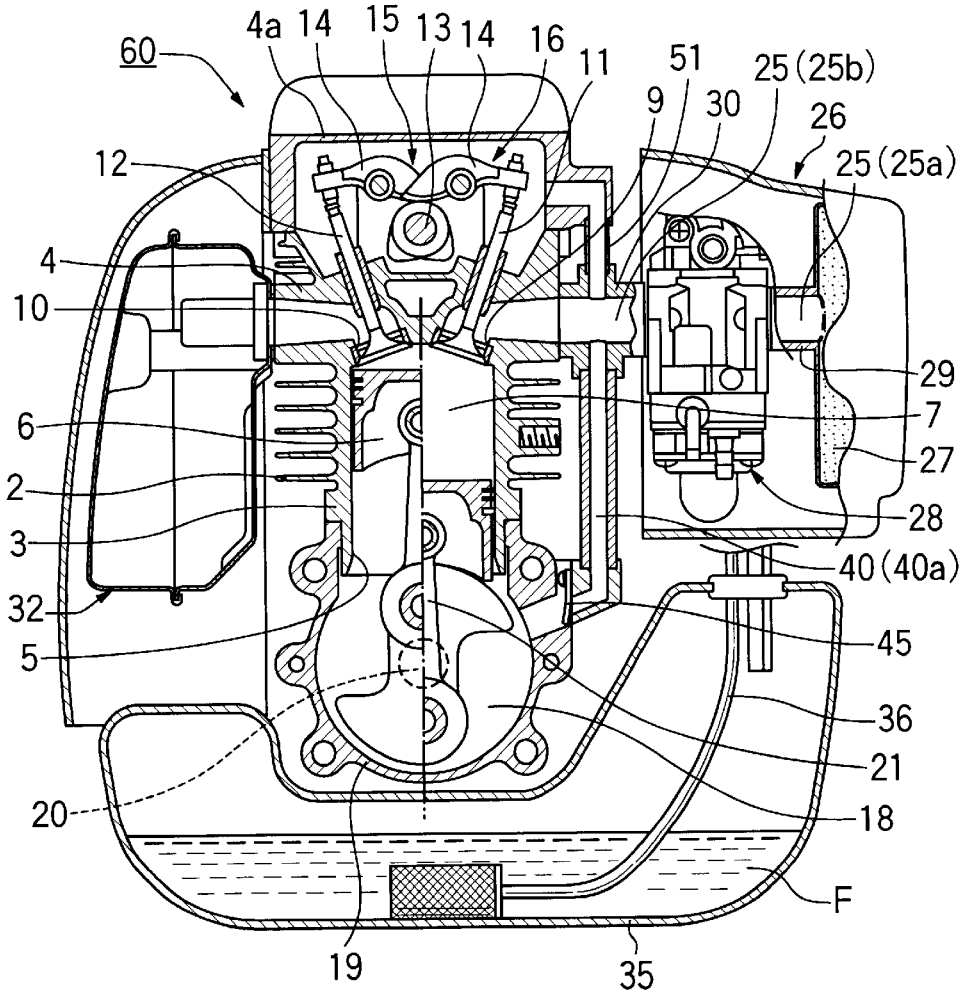
FIG. 5 is a longitudinal sectional view of an engine taken on a plane normal to a crankshaft, illustrating a third embodiment of the present invention.

The third lead valve 52 is not necessarily indispensable but may be dispensed with, as an engine 60 of a third embodiment shown in FIG. 5. The engine 60 (FIG. 5) of the third embodiment has the same configuration with that of the engine 50 (FIG. 4) of the second embodiment with an exception that the engine 60 has no third lead valve 52 which is included in the engine 50 of the second embodiment.

Figure 6A:
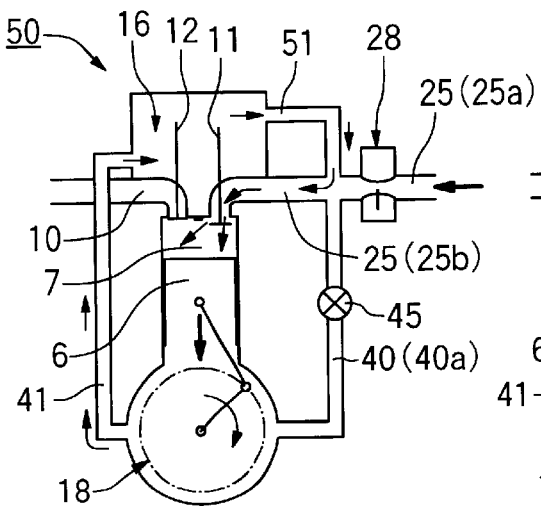
Figure 6B:
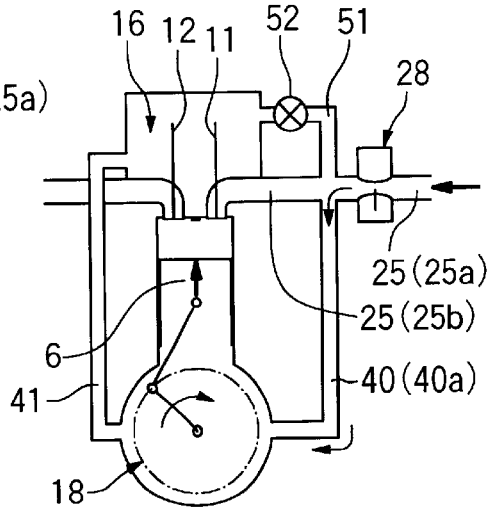
Figure 6C:
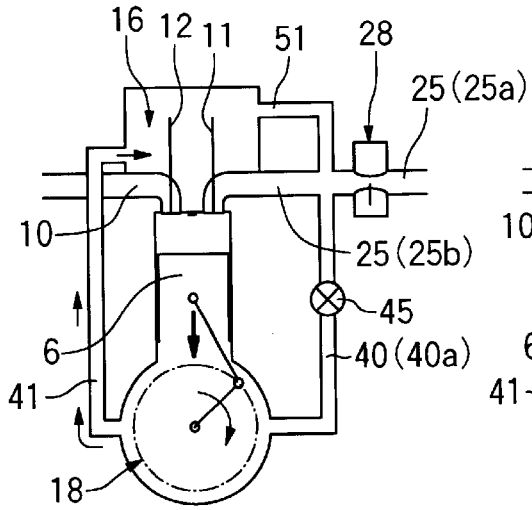
Figure 6D:
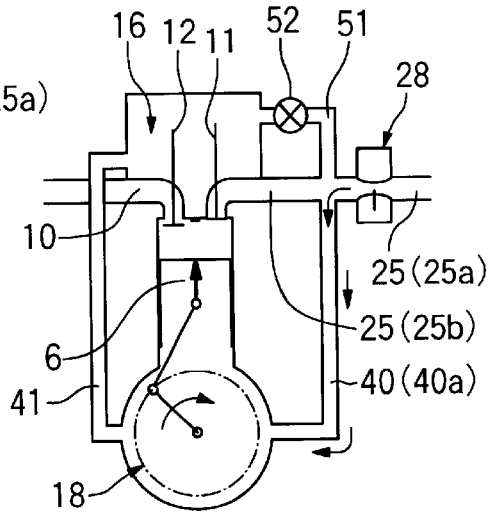

Then the operation of the engine 50 of the second embodiment will be described with reference to FIG. 6. FIG. 6 is an operation chart of the engine 50 of the second embodiment in which FIG. 6*a* shows an intake stroke, FIG. 6*b* shows a compression stroke, FIG. 6*c* shows an expansion stroke and FIG. 6*d* shows an exhaust stroke. In FIGS. 6*a* to 6*d*, the first and the third lead valves 45, 52 are symbolically shown only when they are closed.

Since the operation of the engine 50 during the intake stroke and the exhaust stroke is basically the same with that of the engine 1 of the first embodiment shown in FIG. 3, the duplicate description will be avoided. In the engine 50 of the second embodiment, when it moves from the exhaust stroke to the intake stroke thereof, as can be seen from FIG. 6*a*, the air-fuel mixture having been introduced into the valve chamber 16 flows through the third outer pipe 51 into the downstream side air intake passage 25*b*, and then the air-fuel mixture flowed back to the downstream side air intake passage 25*b* is introduced into the combustion chamber 7 through the intake port 9.

That is, according to the engine 50, in the compression stroke (FIG. 6*b*) and the exhaust stroke (FIG. 6*d*), the air-fuel mixture in the downstream side air intake passage 25*b* is introduced through the branch passage 40*a* into the crank chamber 18 so that the air-fuel mixture introduced into the crank chamber 18 lubricates the internal components thereof, and then is introduced into the valve chamber 16 during the expansion stroke (FIG. 6*c*) or the intake stroke (FIG. 6*a*) to lubricate the valve system 15, and eventually flows back to the air intake passage 25 (downstream side air intake passage 25*b*), during the intake stroke (FIG. 6*a*) to be introduced into the combustion chamber 7 through the intake port 9. As for the lubrication within the engine,the same can be applied to the third engine 60 in FIG. 5.

Thus, in the engines 50, 60, the air-fuel mixture is introduced into the crank chamber 18 and the valve chamber 16 during a series of engine strokes, as in the engine 1 (FIG. 1) of the first embodiment described above, and provides a necessary lubrication for the engine internals by the lubricant which is contained in the air-fuel mixture as described above. Accordingly, the oil reservoir generally indispensable to the conventional four-stroke cycle internal combustion engine is not necessary, and consequently there is no fear of engine's 50, 60 falling into unstable condition due to an insufficient lubrication even when, for example, the 40 grass trimmer equipped with the engine; 50 or 60 (not shown) is excessively tilted clockwise or counter-clockwise during operation thereof.

Figure 7:
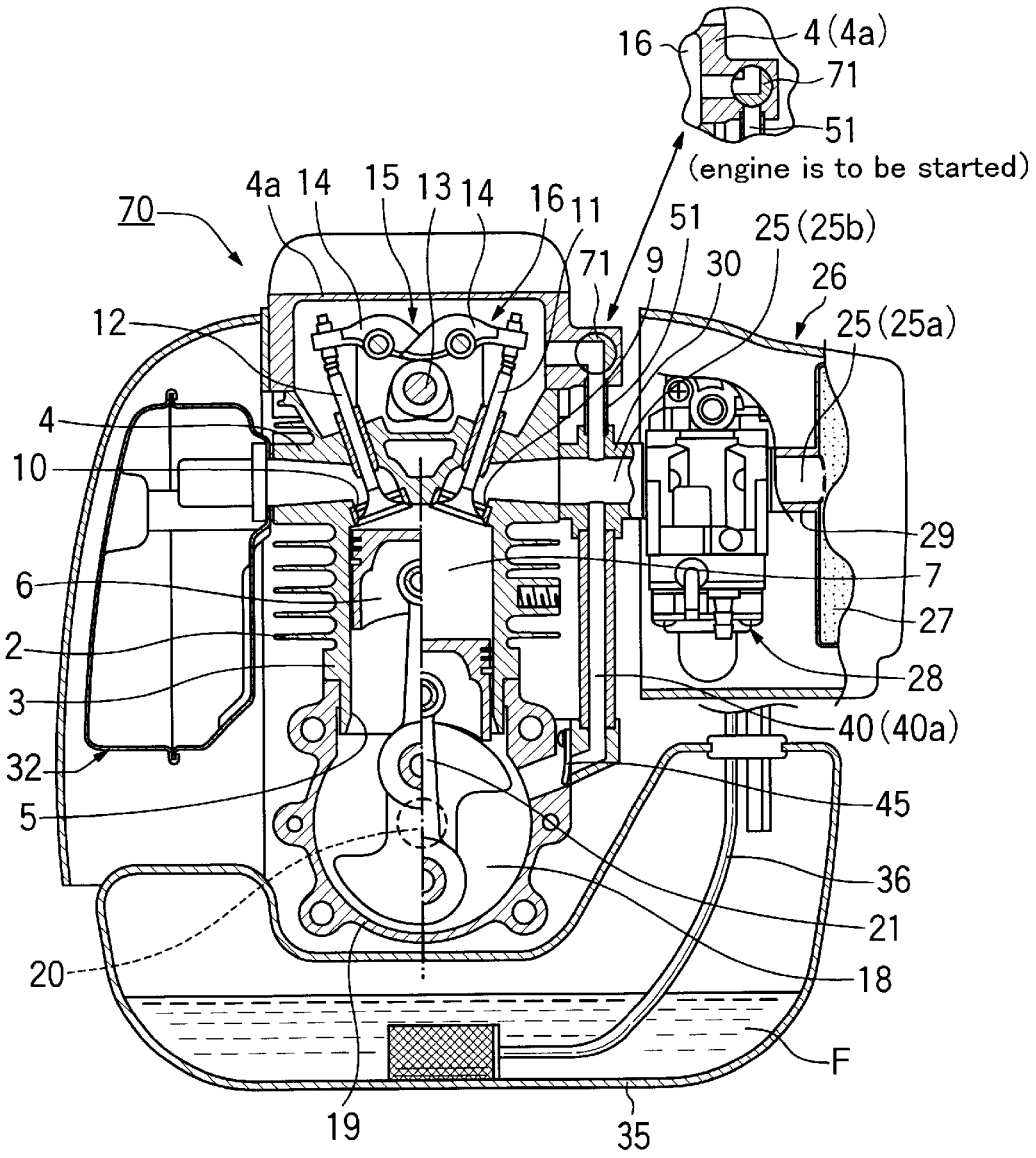
FIG. 7 is a longitudinal sectional view of, an engine taken on a plane normal to a crankshaft, illustrating a fourth embodiment of the present invention.

FIG. 7 is a longitudinal sectional view of an engine taken on a plane normal to a crankshaft, illustrating a fourth embodiment of the present invention. An engine 70 shown in FIG. 7 has the same basic configuration with that of the engine 50 (FIG. 4) of the second embodiment described above. That is, the engine 70 of the fourth embodiment also has the third outer pipe 51 connecting the cylinder head 4 (or the head cover 4*a*) to the downstream side intake pipe 30 so that the air-fuel mixture in the valve chamber 16 may flow into the downstream side air intake passage 25*b*.

The engine 70 of the fourth embodiment employs a first rotary valve 71 in place of the third lead valve 52 employed in the engine 50 of the second embodiment, in order to control a communication between the valve chamber 16 and the downstream side air intake passage 25*b*. That is, the first rotary valve 71 is mounted on: an outlet portion of the valve chamber 16 so as to be interposed between the valve chamber 16 and the downstream side air intake passage 25*b* in order to control the communication therebetween. The first rotary valve 71 is a two port valve which keeps communication between the valve chamber 16 and the downstream side air intake passage 25*b* under normal driving condition but intercepts the communication therebetween only when the engine 70 is to be started (see a partial sectional view added to the overall sectional view of engine 70 in FIG. 7).

According to the engine 70 of the fourth embodiment, there is provided an advantage in that the air-fuel mixture diluted in the valve chamber 16 while the engine 70 being out of operation can be prevented from being introduced into the downstream air intake passage 25*b* through the third outer pipe 51 when the engine 70 is to be started so as not to dilute the air-fuel mixture introduced into the combustion chamber 7 from the carburetor 28 through the downstream side air intake passage 25*b* and the intake port 9.

Figure 8:
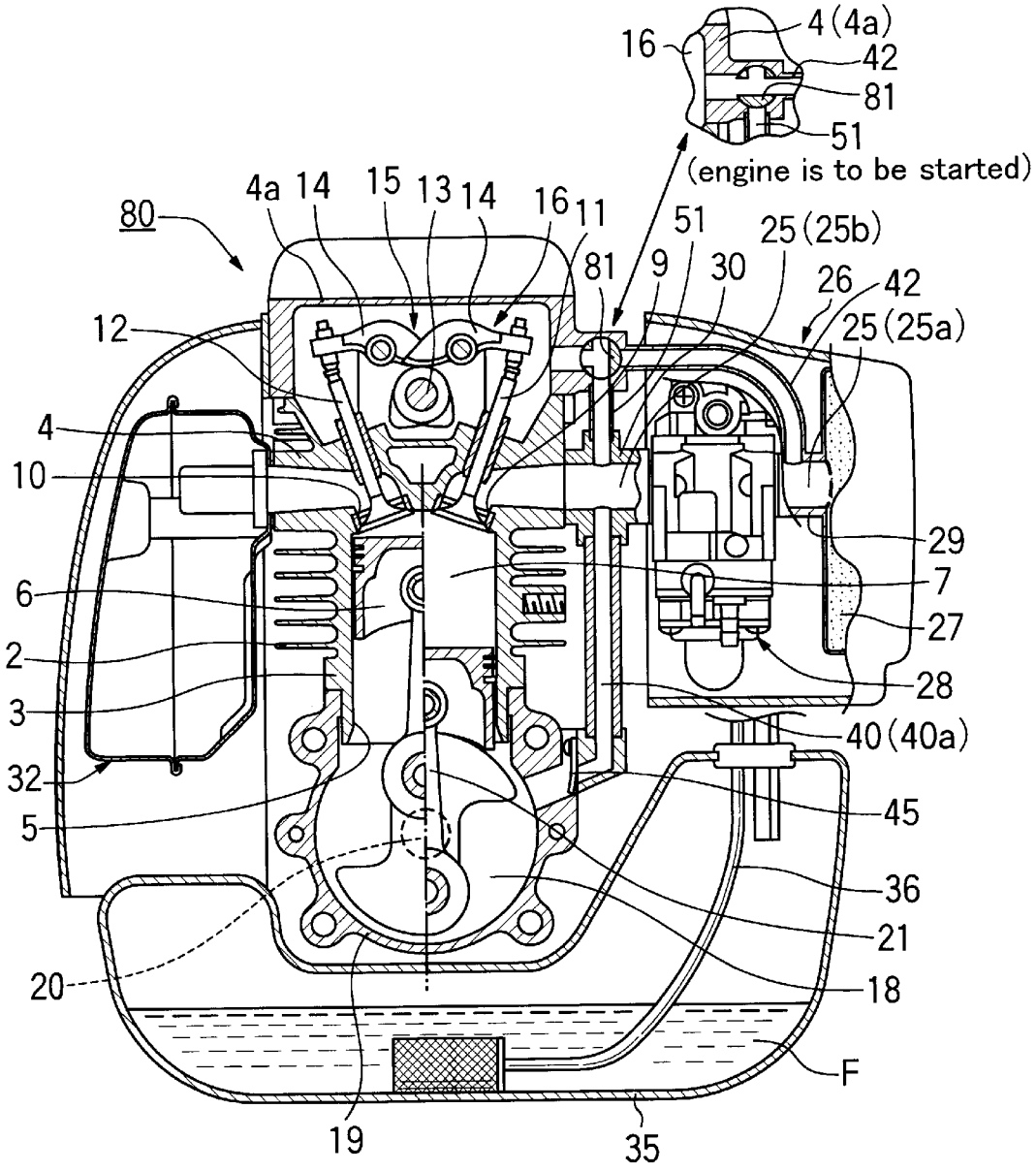
FIG. 8 is a longitudinal sectional view of an engine taken on a plane normal to a crankshaft, illustrating a fifth embodiment of the present invention.

FIG. 8 is a longitudinal sectional view of an engine taken on a plane normal to a crankshaft, illustrating a fifth embodiment of the present invention. The engine 80 shown in FIG. 8 is configured by adding the second outer pipe 42 (FIG. 1) to the engine 70 (FIG. 7) of the fourth embodiment so that the air-fuel mixture in the valve chamber 16 may selectively flow back to the upstream side air intake passage 25*a* or to the downstream side air intake passage 25*b* controlled by a second rotary valve 81.

That is, the valve chamber 16 is capable of communicating with the upstream side air intake passage 25*a* through the second outer pipe 42 as well as with the downstream side air intake passage 25*b* through the third outer pipe 51. In addition, the second rotary valve 81 is mounted on an outlet portion of the valve chamber 16 so as to be interposed between the valve chamber 16 and the upstream and the downstream side air intake passages 25*a*, 25*b*.

The second rotary valve 81 is a three port valve, and when it is in its first position, as can be seen from a condition of the second rotary valve 81 illustrated in FIG. 8 incorporated within; the overall drawing of the engine 80, the valve chamber 16 communicates with the downstream side air intake chamber 25*b* through the third outer pipe 51 and the communication of the valve chamber 16 with the upstream side air intake passage 25*a* through the second outer pipe 42 is intercepted.

When the second rotary valve 81 is in its second position, as can be seen from a partial sectional view added to the overall sectional view of engine 80 in FIG. 8, the valve chamber 116 communicates with the upstream side air intake passage 25*a* through the outer pipe 42 and the communication of the valve chamber 16 with the downstream side air intake passage 25*b* through the third outer pipe 51 is intercepted.

When the engine 80 is to be started, the second rotary valve 81 allows the valve chamber 16 to communicate with the upstream side air intake passage 25*a* (the second position) so as for the air-fuel mixture in the valve chamber 16 to flow back to the upstream side air intake passage 25*a*, while, in a normal driving condition other than starting, the second rotary valve 81 is kept in a position (the first position) where the valve chamber 16 is allowed to communicate with the downstream side air intake passage 25*b*.

According to the engine 80 of the fifth embodiment, there is provided an advantage in that, even if the air-fuel mixture diluted in the valve chamber 16 while the engine 80 being out of operation is introduced into the upstream side air intake passage 25*a* through the second outer pipe 42 when the engine 80 is to be started, the air-fuel mixture introduced into the combustion chamber 7 is led to be rather richer since the possibly diluted mixture from the valve chamber 16 is introduced through the carburetor 27 and the inlet port 9 into the combustion chamber 7, which provides an improved startability and a stable driving during starting and succeeding period thereof.

The present invention has thus been shown and described with reference to specific embodiments. However, it should be noted that the present invention is in no way limited to the details of the described arrangements but changes and modifications may be made without departing from the scope of the appended claims.

What is claimed is:

1. A four-stroke cycle internal combustion engine whose inside is lubricated using a mixed fuel composed of fuel and lubricant added thereto, said engine comprising:

a combustion chamber;

an intake port which opens toward said combustion chamber;

an air intake passage in communication with said intake port, a fuel supply device for supplying said mixed fuel to said air intake passage;

a downstream side air intake passage which bifurcates from said air intake passage and is located on a downstream side of said fuel supply device;

a crank chamber;

a crank shaft disposed within said crank chamber;

a branch passage for placing said downstream side air intake passage in communication with said crank chamber;

a valve chamber;

a valve system disposed within said valve chamber, said valve system including an intake valve and an exhaust valve;

a communication passage for placing said crank chamber in communication with said valve chamber;

a circulation passage for providing communication between said valve chamber and said air intake passage;

a first valve disposed within said branch passage for opening and closing said branch passage and an upstream side air intake passage located on an upstream side of said fuel supply device of said air intake passage; and wherein said circulation passage places said valve chamber in communication with said upstream side air intake passage.

2. A four-stroke cycle internal combustion engine in accordance with claim 1, wherein said first valve is a first lead valve for allowing a fluid flow from said downstream side air intake passage into said crank chamber when a pressure within said crank chamber is lower than a pressure within said downstream side air intake passage, said first lead valve also prohibiting a backward flow from said crank chamber into said downstream side air intake passage when the pressure within said crank chamber is higher than the pressure within said downstream side air intake passage.

3. A four-stroke cycle internal combustion engine whose inside is lubricated using a mixed fuel composed of fuel and lubricant added thereto, said engine comprising:

a combustion chamber;

an intake port which opens toward said combustion chamber;

an air intake passage in communication with said intake port, a fuel supply device for supplying said mixed fuel to said air intake passage;

a downstream side air intake passage which bifurcates from said air intake passage and is located on a downstream side of said fuel supply device;

a crank chamber;

a crank shaft disposed within said crank chamber;

a branch passage for placing said downstream side air intake passage in communication with said crank chamber;

a valve chamber;

a valve system disposed within said valve chamber, said valve system including an intake valve and an exhaust valve;

a communication passage for placing said crank chamber in communication with said valve chamber;

a circulation passage for providing communication between said valve chamber and said air intake passage;

a first valve disposed within said branch passage for opening and closing said branch passage and a second lead valve disposed within said circulation passage, wherein said second lead valve permits a fluid within said valve chamber to flow into said air intake passage when a pressure in said valve chamber is higher than a pressure within said air intake passage and said second lead valve prohibits a fluid flow from said air intake passage into said valve chamber when the pressure in said valve chamber is lower than the pressure within said air intake passage.

4. A four-stroke cycle internal combustion engine in accordance with claim 3, wherein said circulation passage places said valve chamber in communication with said downstream side air intake passage.

5. A four-stroke cycle internal combustion engine in accordance with claim 3, wherein said first valve is a first lead valve for allowing a fluid flow from said downstream side air intake passage into said crank chamber when a pressure within said crank chamber is lower than a pressure within said downstream side air intake passage, said first lead valve also prohibiting a backward flow from said crank chamber into said downstream side air intake passage when the pressure within said crank chamber is higher than the pressure within said downstream side air intake passage.

6. A four-stroke cycle internal combustion engine in accordance with claim 5, wherein said circulation passage places said valve chamber in communication with said downstream side air intake passage.

7. A four-stroke cycle internal combustion engine in accordance with claim 5, further comprising an upstream side air intake passage located on an upstream side of said fuel supply device of said air intake passage; and wherein said circulation passage places said valve chamber in communication with said upstream side air intake passage.

8. A four-stroke cycle internal combustion engine whose inside is lubricated using a mixed fuel composed of fuel and lubricant added thereto, said engine comprising:

a combustion chamber;

an intake port which opens toward said combustion chamber;

an air intake passage in communication with said intake port, a fuel supply device for supplying said mixed fuel to said air intake passage;

a downstream side air intake passage which bifurcates from said air intake passage and is located on a downstream side of said fuel supply device;

a crank chamber;

a crank shaft disposed within said crank chamber;

a branch passage for placing said downstream side air intake passage in communication with said crank chamber;

a valve chamber;

a valve system disposed within said valve chamber, said valve system including an intake valve and an exhaust valve;

a communication passage for placing said crank chamber in communication with said valve chamber;

a circulation passage for providing communication between said valve chamber and said air intake passage;

a first valve disposed within said branch passage for opening and closing said branch passage and a switch valve for opening and closing said circulation passage interposed within said circulation passage.

9. A four-stroke cycle internal combustion engine in accordance with claim 8, wherein said first valve is a first lead valve for allowing a fluid flow from said downstream side air intake passage into said crank chamber when a pressure within said crank chamber is lower than a pressure within said downstream side air intake passage, said first lead valve also prohibiting a backward flow from said crank chamber into said downstream side air intake passage when the pressure within said crank chamber is higher than the pressure within said downstream side air intake passage.

10. A four-stroke cycle internal combustion engine whose inside is lubricated using a mixed fuel composed of fuel and lubricant added thereto, said engine comprising:

a combustion chamber;

an intake port which opens toward said combustion chamber;

an air intake passage in communication with said intake port, a fuel supply device for supplying said mixed fuel to said air intake passage;

a downstream side air intake passage which bifurcates from said air intake passage and is located on a downstream side of said fuel supply device;

a crank chamber;

a crank shaft disposed within said crank chamber;

a branch passage for placing said downstream side air intake passage in communication with said crank chamber;

a valve chamber;

a valve system disposed within said valve chamber, said valve system including an intake valve and an exhaust valve;

a communication passage for placing said crank chamber in communication with said valve chamber;

a circulation passage for providing communication between said valve chamber and said air intake passage;

a first valve disposed within said branch passage for opening and closing said branch passage and an upstream side air intake passage located on an upstream side of said fuel supply device of said air intake passage, wherein said circulation passage connects said valve chamber to said downstream side air intake passage and said upstream side air intake passage, and a second valve for selectively opening and closing a communication passage between said valve chamber and said downstream side air intake passage and another communication passage between said valve chamber and said upstream side air intake passage.

11. A four-stroke cycle internal combustion engine in accordance with claim 10, wherein said first valve is a first lead valve for allowing a fluid flow from said downstream side air intake passage into said crank chamber when a pressure within said crank chamber is lower than a pressure within said downstream side air intake passage, said first lead valve also prohibiting a backward flow from said crank chamber into said downstream side air intake passage when the pressure within said crank chamber is higher than the pressure within said downstream side air intake passage.

* * * * *